US005285183A

United States Patent [19]

Asada

[11] Patent Number: 5,285,183

[45] Date of Patent: Feb. 8, 1994

[54] TEMPERATURE SWITCH

[75] Inventor: Isamu Asada, Kiyose, Japan

[73] Assignee: Nihon Seiken Kabushiki Kaisha, Saitama, Japan

[21] Appl. No.: 15,830

[22] Filed: Feb. 10, 1993

[30] Foreign Application Priority Data

May 7, 1992 [JP] Japan ..... 4-158484

[51] Int. Cl.[5] ..... H01H 37/04; H01H 37/52

[52] U.S. Cl. ..... 337/372; 337/354; 337/380

[58] Field of Search ..... 337/380, 372, 354, 343, 337/112

[56] References Cited

U.S. PATENT DOCUMENTS 2,785,251 3/1957 Cassidy ..... 337/343

4,689,559 8/1987 Calenda et al. ..... 337/380

*Primary Examiner*—Harold Broome

*Attorney, Agent, or Firm*—Nikaido Marmelstein Murray & Oram

[57] ABSTRACT a temperature switch is disclosed which has a bimetal disc being inversely deformed between a concave shape and a convex shape according to a temperature change. A bottom portion including the outer periphery of a casing of the temperature switch is in a plane shape. At an inner position of the outer periphery of the bottom portion, a protruding line for supporting an outer peripheral portion of the disc is formed. When the temperature switch is used in such a way that the outer surface of the bottom portion is in contact with a test subject, since heat is transferred from both iner and outer side walls of the protruding line to the disc, the delay of thermal transfer can be reduced.

1 Claim, 4 Drawing Sheets

TEMPERATURE SWITCH

BACKGROUND OF THE INVENTION

1. Field of the Invention

The present invention relates to a temperature switch or performing on/off operation according to a temperature change, in particular, to a temperature switch with a bimetal disc which inversely deforms between a concave shape and a convex shape according to a temperature change.

2. Description of the Prior Art

As a prior art reference, a temperature switch 1 with the construction shown in FIG. 4 has been used. The temperature switch 1 has a shoulder portion 3 on the outer periphery of a lower portion of a casing 2. On the shoulder portion 3, a bimetal disc 4 is disposed. A center portion of the disc 4 is connected to a switch portion 5 with a rod 6.

Conventionally, this temperature switch 1 is used in such a manner that the outer surface of a bottom portion of the casing 2 is in contact with a test subject in a plane shape. When the temperature of the test subject 7 changes, the temperature change is transferred to the disc 4 through the casing 2. Thus, the disc 4 was deformed from a concave shape to a convex shape. The disc 4 which was deformed in the convex shape causes the rod 6 to upwardly move and the switch portion 5 to operate.

This type of temperature switch is used for applications such as an alarm apparatus or a temperature control apparatus. Thus, when an abrupt temperature change takes place in a test subject, it should be detected as soon as possible without a delay.

SUMMARY OF THE INVENTION

An object of the present invention is to provide a temperature switch with a higher response characteristic than those in the prior art reference.

The first aspect of the present invention is a temperature switch comprising a casing for covering the temperature switch, and a bimetal disc disposed at a lower position of the casing, wherein the bimetal disc is inversely deformed between a concave shape and a convex shape according to a temperature change. The switch portion is driven according to a displacement of a center portion of the bimetal disc, and wherein the outer surface of a bottom portion of the casing including the outer periphery thereof is in a plane shape, the bottom portion having a protruding line disposed at an inner position of the outer periphery thereof, the protruding line upwardly protruding and being in a ring shape, the bottom portion and the protruding line being integrally formed, the protruding line being adapted to support the outer periphery of the bimetal disc.

The second aspect of the present invention is the temperature switch according to the first aspect of the present invention, wherein the casing has a holding portion made of a heat resisting substance such as plastic, the holding portion being apart from the inner surface of the bottom portion of the casing, the holding portion embracing the outer end of the bimetal disc so as to hold thereof.

The third aspect of the present invention is the temperature switch according to the first aspect of the present invention, wherein the casing has a holding protruding line disposed at an outer position of the protruding line on the inner surface of the bottom portion of the casing, the holding protruding line upwardly protruding, the holding protruding line and the bottom portion of the casing being integrally formed, the holding protruding line embracing the outer end of the bimetal disc so as to hold thereof.

Since the temperature switch according to the present invention has a bottom portion of the casing whose outer surface including the outer periphery is in a plane shape and the disc is held by the protruding line, heat is effectively transferred from the test subject to the disc. When an abrupt temperature change takes place in the test subject, the delay for which the temperature change is detected is small. Thus, the response characteristic of the temperature switch is high.

In addition, the temperature switch with the holding portion can have a higher response characteristic since the holding portion prevents heat from escaping out of the disc.

Moreover, the temperature switch with the holding protruding line can have a higher response characteristic since the holding protruding line prevents heat from escaping out of the disc.

These and other objects, features and advantages of the present invention will become more apparent in light of the following detailed description of a best mode embodiment thereof, as illustrated in the accompanying drawings.

DESCRIPTION OF THE PREFERRED EMBODIMENTS

Next, with reference to the accompanying drawings, embodiments according to the present invention will be described.

Figure 1:
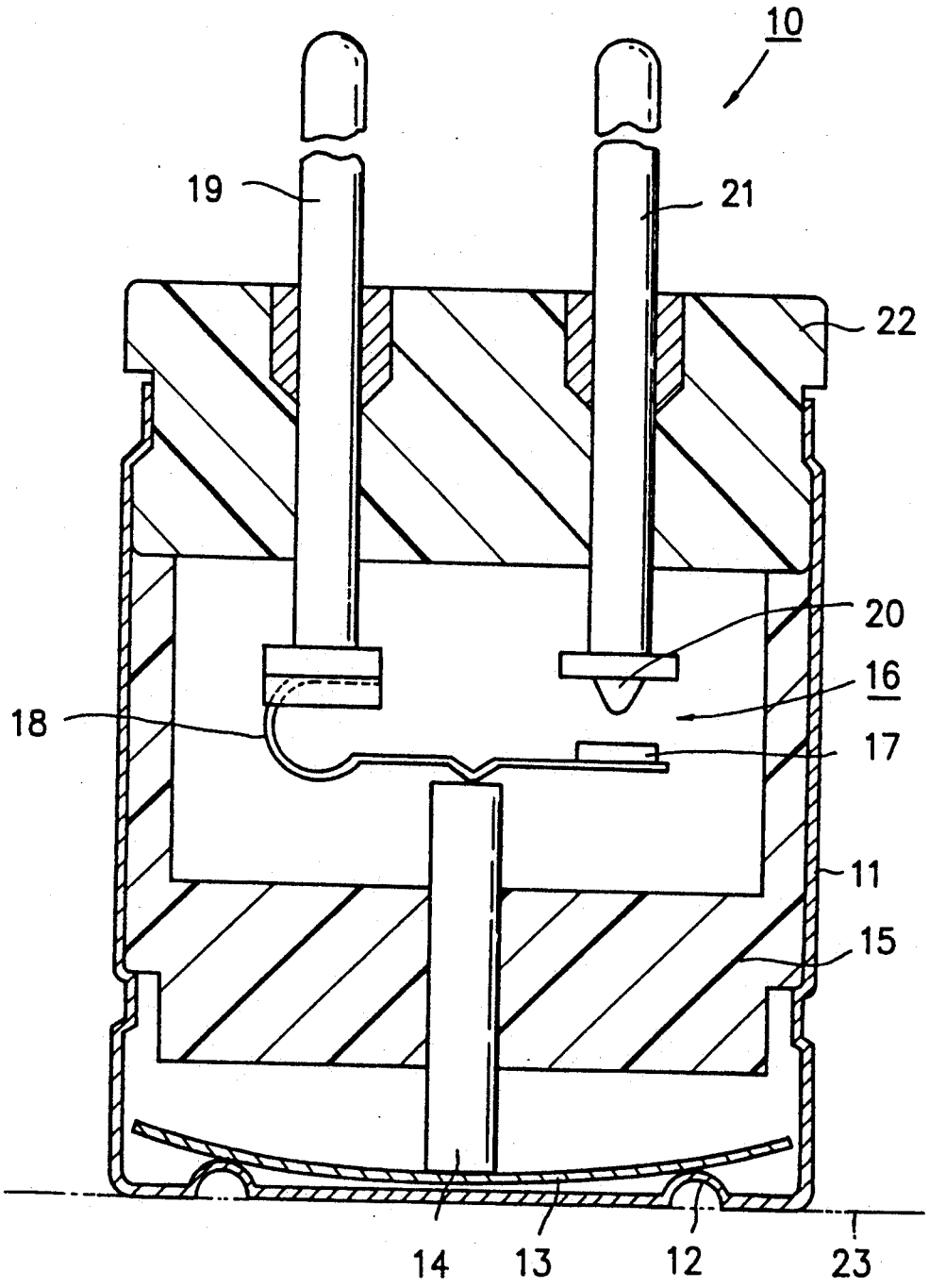
FIG. 1 is a front sectional view showing a first embodiment according to the present invention.

First, with reference to FIG. 1, a temperature switch 10 of a first embodiment according to the present invention will be described.

The temperature switch 10 is covered by a casing 11. The casing 11 is in a nearly cup shape and made of a thin metal plate. The bottom portion of the casing 11 including the outer periphery thereof is in a plane shape. The casing 11 has a protruding line 12 disposed at an inner position of the outer periphery thereof. The protruding line 12 upwardly protrudes and is in a ring shape. The protruding line 12 and the casing 11 are integrally formed by a press forming process.

At a lower portion inside the casing 11, a bimetal disc 13 is disposed. The outer peripheral portion of the bimetal disc 13 is supported by the protruding line 12. The disc 13 is inversely deformed between a concave shape (shown in the figure) and a convex shape (not shown in the figure) according to a temperature change thereof. The outer end of the disc 13 is embraced and held by the side wall of the casing 11.

At a center portion of the disc 13, a rod 14 is disposed. The rod 14 is movably guided by a guide member 15. The guide member 15 is fitted to and held by the casing 11.

At the upper end of the rod 14, a switch portion 16 is disposed. The switch portion 16 comprises a resilient plate 18, a first electrode 19, and a second electrode 21. The resilient plate 18 has a movable contact 17 disposed at an end thereof. The resilient plate 18 is connected to an end of the first electrode 19. The second electrode 21 has a fixed contact 20 disposed at an end thereof. The moving contact 17 is opposed to the fixed contact 20. By the resilient force of the resilient plate 18, the movable contact 17 is kept apart from the fixed contact 20. The center portion of the resilient plate 18 is disposed so that the upper end of the rod 14 is downwardly pressed. Thus, when the rod 14 upwardly moves, the movable contact 17 is brought in contact with the fixed contact 20 and thereby the switch portion 16 is turned on. In contrast, when the rod 14 downwardly moves, the movable contact 17 is released from the fixed contact 20 and thereby the switch portion 16 is turned off.

The electrodes 19 and 21 pass through and are held by a cover member 22 which is fitted and caulked to an upper end portion of the casing 11. The electrodes 19 and 21 protrude from an upper portion of the cover member 22 and are connected to a circuit for use with the temperature switch 10.

As with the prior art reference, when the temperature switch 10 is used, the outer surface of the bottom portion of the casing 11 is brought in contact with a test subject 23 in a plane shape. When the temperature of the test subject 23 changes, the disc 13 is inversely deformed between a convex shape and a concave shape, thereby upwardly moving the rod 14 and operating the switch portion 16.

By the following operation, the temperature switch 10 of this embodiment has a higher response characteristic than the temperature switch 1 of the prior art reference.

According to the temperature switch 10 of this embodiment, the temperature change of the test subject 23 is transferred to the outer surface of the bottom portion of the casing 11. Next, the temperature is transferred to the disc 13 through the protruding line 12. In contrast, according to the temperature switch 1 of the prior art reference, the temperature change of the test subject 7 is transferred to the outer surface of the bottom portion of the casing 2. Next, the temperature is transferred to the disc 4 through the shoulder portion 3.

The outer surface of the bottom portion of the casing 2 of the temperature switch 1 according to the prior art reference has the shoulder portion at an inner position of the outer periphery thereof and thereby only the center portion of the outer surface thereof is in contact with the test subject 7. In contrast, the outer surface of the bottom portion of the casing 11 of the temperature switch 10 according to this embodiment is in a plane shape and thereby the entire outer surface thereof including the outer periphery thereof is in contact with the test subject 23. Thus, according to this embodiment, the contact area of the casing 11 with the test subject 23 is large and thereby the heat can be effectively transferred to the casing 11.

According to the temperature switch 1 of the prior art reference, the heat is transferred from the inner surface of the bottom portion of the casing 2 to the disc 4 through the shoulder portion 3 which has only one wall. In contrast, according to the temperature switch 10 of the embodiment, since the heat is transferred from the inner surface of the bottom portion of the casing 11 to the disc 13 through the two side walls of the protruding line 12, the thermal transfer ratio of the present invention is approximately twice as high as that of the prior art reference.

Figure 2:
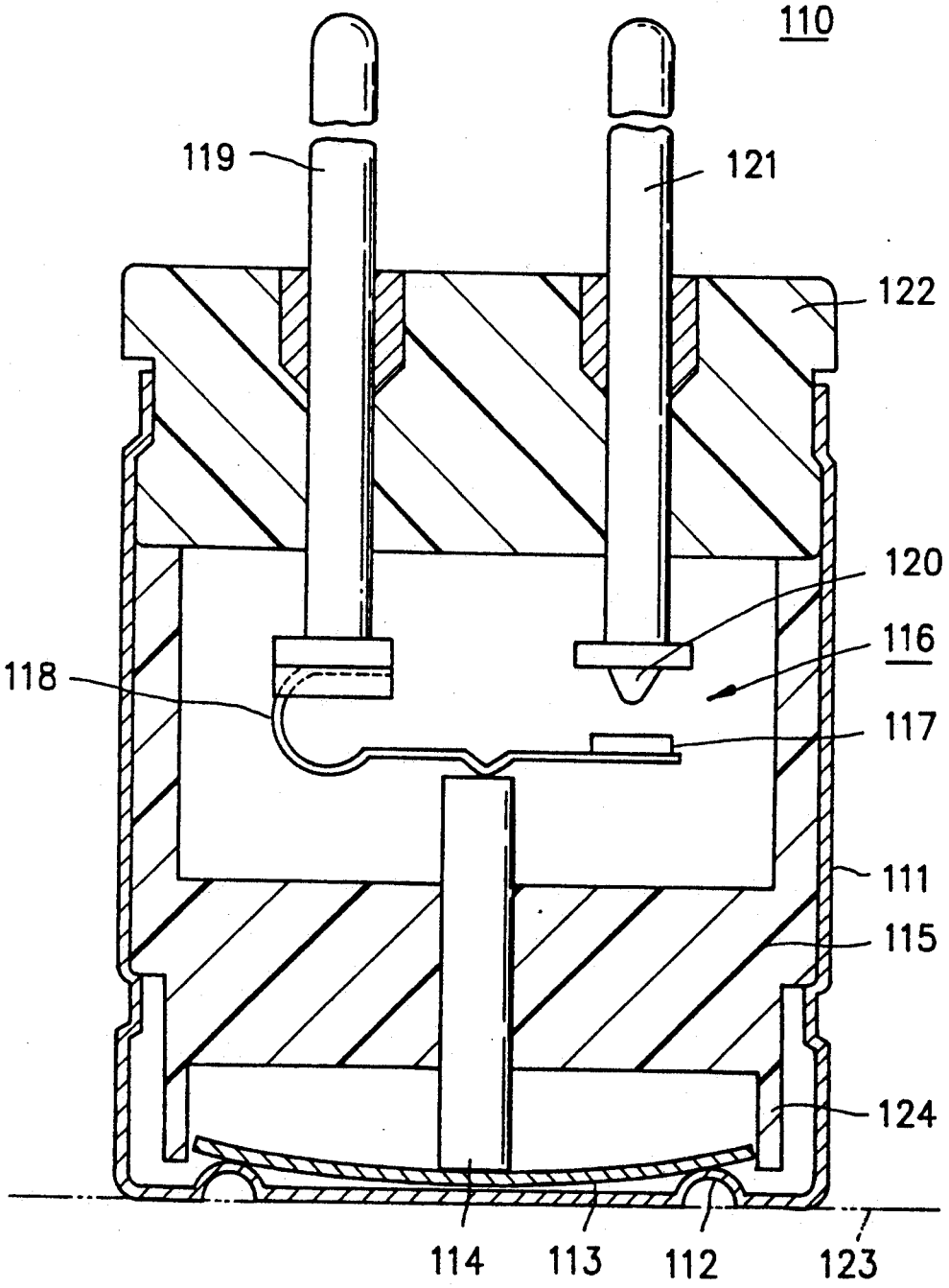
FIG. 2 is a front sectional view showing a second embodiment according to the present invention.

Next, with reference to FIG. 2, a temperature switch 110 according to a second embodiment of the present invention will be described.

Since the construction of the temperature switch 110 according to the second embodiment is nearly the same as that of the temperature switch 10 according to the first embodiment, each portion of the temperature switch 110 is represented by adding 100 to the reference numeral of the corresponding portion of the temperature switch 10. In addition, for simplicity, in the second embodiment, the description of the same portions as the first embodiment will be omitted.

The temperature switch 110 has a guide member 115. The guide member 115 has a holding portion 124 which downwardly protrudes in a ring shape. The holding portion 124 embraces and holds the outer end of a disc 113. The end of the holding portion 124 is apart from the inner surface of the bottom portion of a casing 111, not in contact therewith. The holding portion 124 and the guide member 115 are integrally formed of plastic or ceramic which is a heat resisting substance.

By the similar operation as the temperature switch according to the first embodiment, the temperature switch 110 has a high response characteristic. However, by the following operation, the temperature switch 110 has a higher response characteristic than the temperature switch 10 according to the first embodiment.

According to the temperature switch 1 of the prior art reference, the heat transferred from the shoulder portion 3 to the disc 4 escapes through the outer end of the disc 4 to the side wall of the casing 2 and thereby the temperature change of the disc 4 is weakened. However, according to the temperature switch 110 of the second embodiment, since the outer periphery of the disc 113 is embraced by the holding portion 124 made of a heat resisting substance, the heat transferred to the disc 113 does not escape through the outer end. Thus, the temperature change is effectively transferred to the disc 113. The reason the holding portion 124 is apart from the inner surface of the bottom portion of the casing 111 is to prevent the holding portion 124 from adversely affecting the temperature change of the inner surface of the bottom portion of the casing 111.

Figure 3:
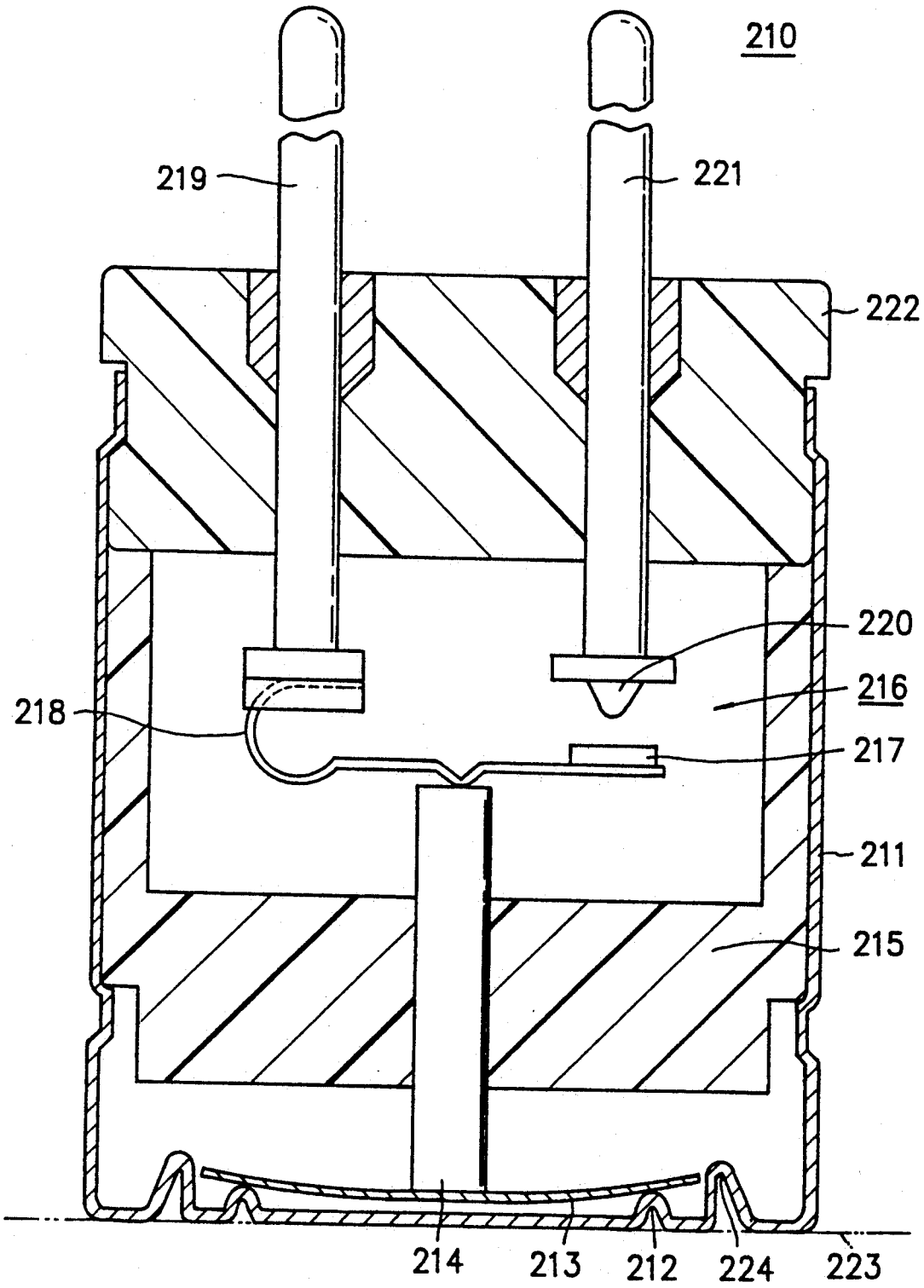
FIG. 3 is a front sectional view showing a third embodiment according to the present invention.
Figure 4:
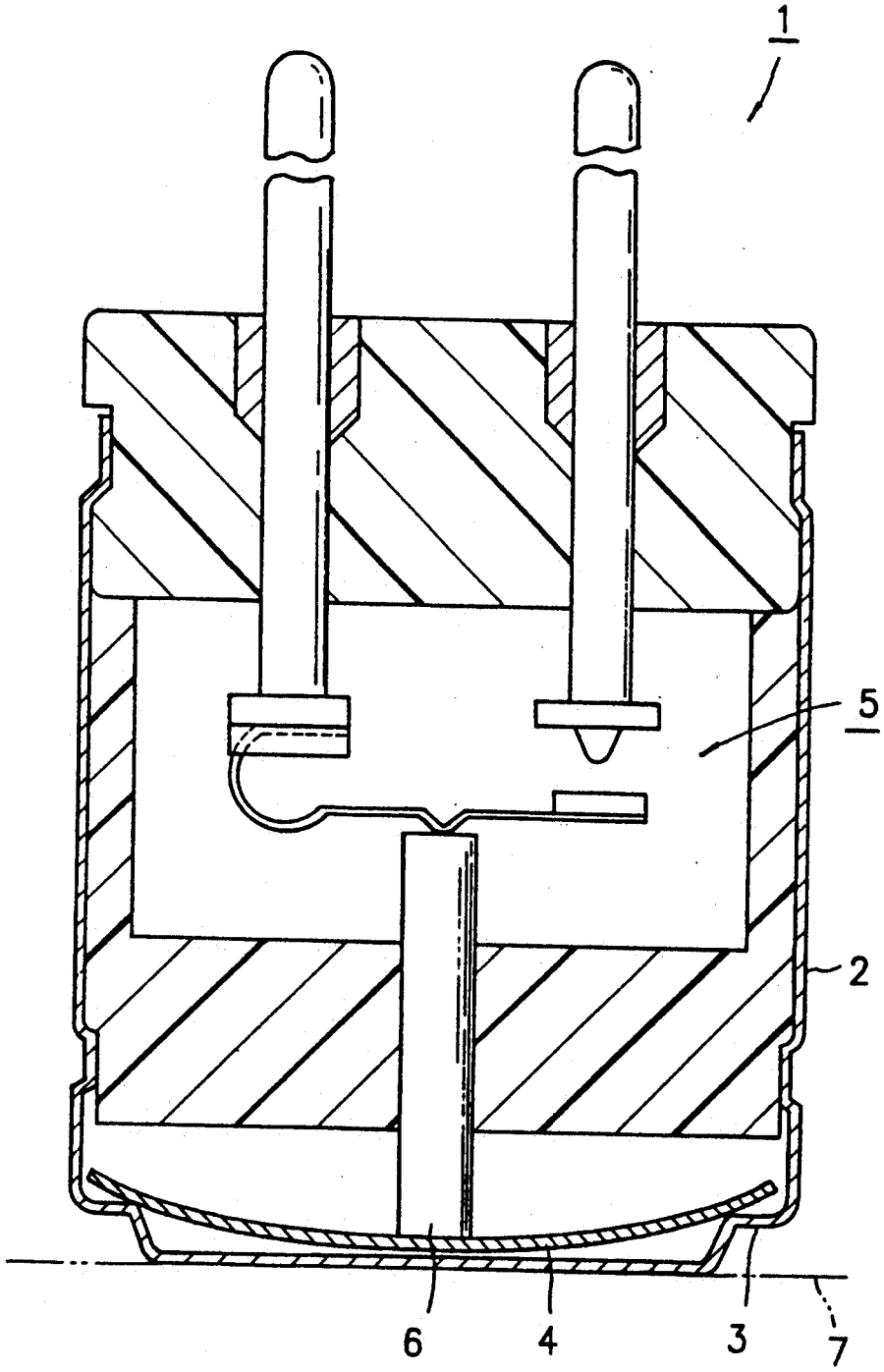
Fig. 4 (Prior Art)
FIG. 4 is a front sectional view showing a prior art reference.

Next, with reference to FIG. 3, a temperature switch 210 according to a third embodiment of the present invention will be described.

Since the construction of the temperature switch 210 according to the third embodiment is nearly the same as that of the temperature switch 10 according to the first embodiment, each portion of the temperature switch 210 is represented by adding 200 to the reference numeral of the corresponding portion of the temperature switch 10. In addition, for simplicity, in the third embodiment, the description of the same portions as the first embodiment will be omitted.

The temperature switch 210 has a casing 211. The casing 211 has a holding protruding line 224 which upwardly protrudes. The holding protruding line 224 is disposed at an outer position of a protruding line 212. The holding protruding line 224 and the casing 211 are integrally formed. The holding protruding line 224 embraces and holds the outer end of a disc 213.

By the similar operation as the temperature switch according to the first embodiment, the temperature switch 210 has a high response characteristic. However, by the following operation, the temperature switch 210 has a higher response characteristic than the temperature switch 10 according to the first embodiment.

As described above, according to the temperature switch 1 of the prior art reference, the heat escapes through the outer end of the disc 4 to the side wall of the casing 2. In contrast, according to the temperature switch of the third embodiment, since the outer end of the disc 213 is embraced by the holding protruding line 224 and the heat is effectively transferred from the test subject 223 to the disc 213 through the holding protruding line 224 in the same manner as the protruding line 212, the heat transferred to the disc 213 does not almost escape through the outer end. Thus, the temperature change of the test subject 223 can be effectively transferred to the disc 213.

The temperature switch 210 according to the third embodiment is suitable for the case where the size of disc 213 is much smaller than that of the casing 211, namely the size of the switch portion is large.

Although the present invention has been shown and described with respect to a best mode embodiment thereof, it should be understood by those skilled in the art that the foregoing and various other changes, omissions, and additions in the form and detail thereof may be made therein without departing form the spirit and scope of the present invention.

What is claimed is:

1. A temperature switch comprising:

a casing for covering said temperature switch; and a bimetal disc disposed at a lower position of said casing, wherein said bimetal disc is inversely deformed between a concave shape and a convex shape according to a temperature change, a switch portion being driven according to a displacement of a center portion of said bimetal disc, and wherein the outer surface of a bottom portion of said casing including the outer periphery thereof is in a plane shape, the bottom portion having a protruding line disposed at an inner position of the outer periphery thereof, said protruding line upwardly protruding and being in a ring shape, the bottom portion and said protruding line being integrally formed, said protruding line being adapted to support the outer periphery of said bimetal disc, and further said casing has a holding protruding line disposed at an outer position of the protruding line on the inner surface of the bottom portion of said casing, said holding protruding line upwardly protruding, said holding protruding line and the bottom portion of said casing being integrally formed, said holding protruding line embracing the outer end of said bimetal disc so as to hold thereof.

* * * * *